US008033625B2

(12) United States Patent
Kucmerowski et al.

(10) Patent No.: US 8,033,625 B2
(45) Date of Patent: Oct. 11, 2011

(54) APPARATUS AND METHOD OF FILLING INK TANK

(75) Inventors: Douglas E. Kucmerowski, Brockport, NY (US); Robert E. Marowski, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 677 days.

(21) Appl. No.: 11/951,357

(22) Filed: Dec. 6, 2007

(65) Prior Publication Data

US 2009/0147058 A1 Jun. 11, 2009

(51) Int. Cl.
*B41J 2/195* (2006.01)

(52) U.S. Cl. ..... 347/7

(58) Field of Classification Search ..... 347/7, 85
See application file for complete search history.

(56) References Cited

U.S. PATENT DOCUMENTS

| | | | | |
|---|---|---|---|---|
| 4,118,830 | A * | 10/1978 | Weiland | 452/131 |
| 5,479,968 | A * | 1/1996 | Sanchez et al. | 141/110 |
| 6,149,266 | A | 11/2000 | Cook | |
| 2003/0009132 | A1 * | 1/2003 | Schwartz et al. | 604/152 |
| 2003/0067517 | A1 * | 4/2003 | Iri et al. | 347/85 |

* cited by examiner

*Primary Examiner* — Geoffrey Mruk
(74) *Attorney, Agent, or Firm* — William R Zimmerli

(57) ABSTRACT

An apparatus and method of filling a tank with a fluid are provided. The method includes providing the tank including a porous media positioned therein, the tank having a length dimension and a width dimension; providing a plurality of needles, each needle having a first end connectable in fluid communication with a fluid source and a second end including a fluid outlet port, the fluid outlet port having an axis; orienting each needle such that the axis of the fluid outlet port is substantially parallel with a preferred direction, the preferred direction being along one of the length dimension and the width dimension of the tank; inserting each needle into the porous media positioned within the tank; and filling the tank with fluid from the fluid source.

12 Claims, 9 Drawing Sheets

APPARATUS AND METHOD OF FILLING INK TANK

FIELD OF THE INVENTION

This invention relates generally to the field of digitally controlled printing devices, and in particular to apparatuses and methods of filling ink tanks associated with these devices.

BACKGROUND OF THE INVENTION

Ink tank filling processes are known. For a given filling process, several considerations are evaluated and balanced. Generally, it is desirable to maximize the amount of ink available for printing over the lifetime of the ink tank while at the same time minimizing the cost and time associated with filling the tank with ink.

Additionally, it is advantageous during printing to reduce the amount of required printhead over travel. As printhead over travel is related to the width of the printhead, it is advantageous to use narrow (length greater than width) ink tanks. However, as ink tanks become narrower, ink volume requirements cause ink tank lengths to be significantly increased creating the need to minimize the potential of trapping ink in the ink tank that is unavailable for use during printing. This is especially true for ink tanks containing a porous media that provides pressure regulation because capillary forces in the media play a dominant role in the long-term distribution of ink in these tanks.

As such, there is a need to be able to fill narrow ink tanks while reducing the likelihood of trapping ink in the ink tank and minimizing the cost and time associated with filling the tank with ink.

SUMMARY OF THE INVENTION

According to one feature of the invention, a method of filling a tank with a fluid includes providing the tank including a porous media positioned therein, the tank having a length dimension and a width dimension; providing a plurality of needles, each needle having a first end connectable in fluid communication with a fluid source and a second end including a fluid outlet port, the fluid outlet port having an axis; orienting each needle such that the axis of the fluid outlet port is substantially parallel with a preferred direction, the preferred direction being along one of the length dimension and the width dimension of the tank; inserting each needle into the porous media positioned within the tank; and filling the tank with fluid from the fluid source.

According to another feature of the invention, a tank filling apparatus, with the tank including a porous media positioned therein and having a length dimension and a width dimension, includes a fluid source and a plurality of alignment mechanisms. Each alignment mechanism includes a needle, with each needle having a first end connectable in fluid communication with the fluid source and a second end including a fluid outlet port. The fluid outlet port has an axis. A needle holding structure includes a locking mechanism associated with each alignment mechanism. Each alignment mechanism is removably positionable in the needle holding structure such that each alignment mechanism is rotatable when removed from the needle holding structure to orient the axis of the fluid outlet port of each needle substantially parallel along a preferred direction with the preferred direction being one of the length dimension and the width dimension of the tank. The alignment mechanism is retained in position by the locking mechanism when located in the needle holding structure.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
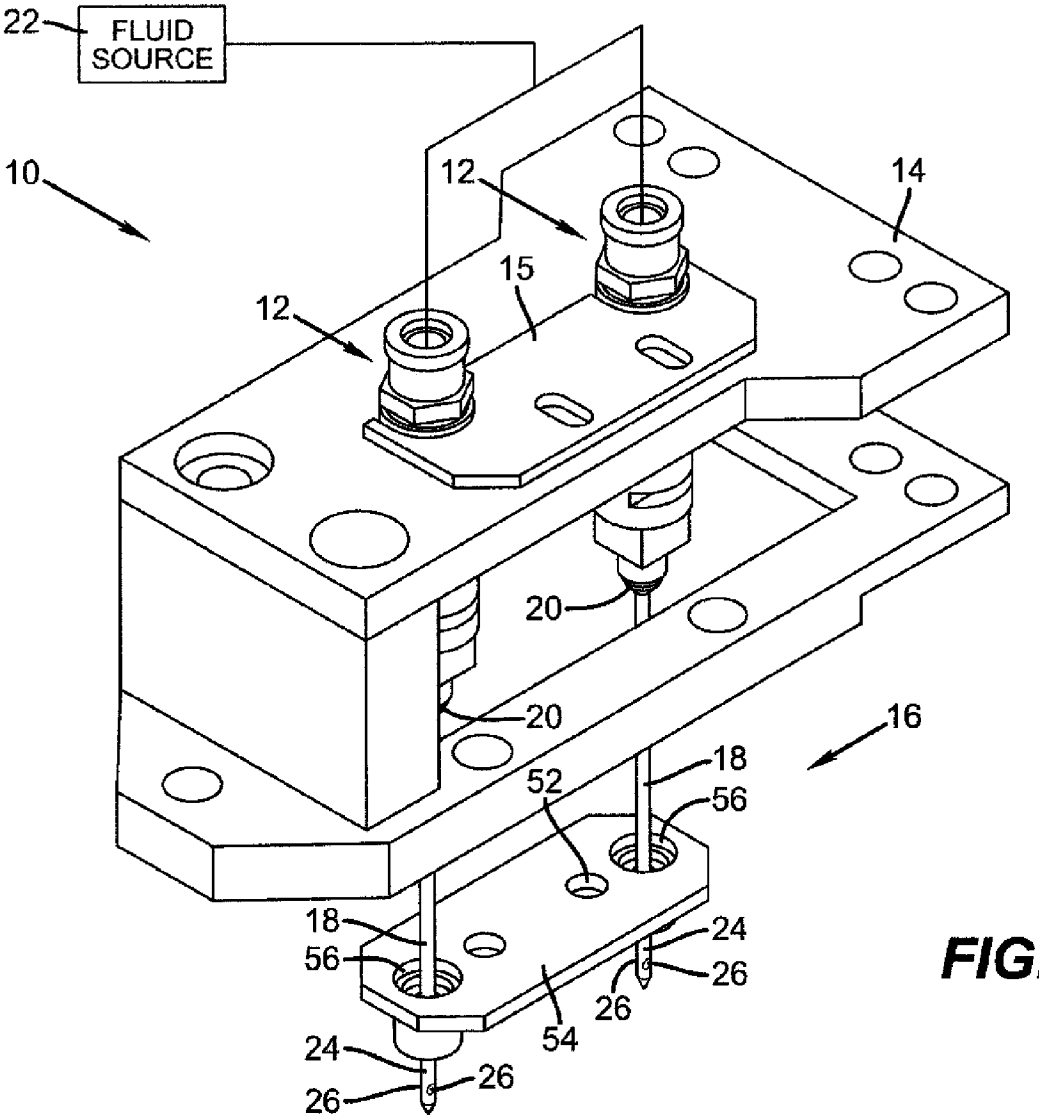
FIG. 1 is a schematic perspective view of an example embodiment of the invention.
Figure 2:
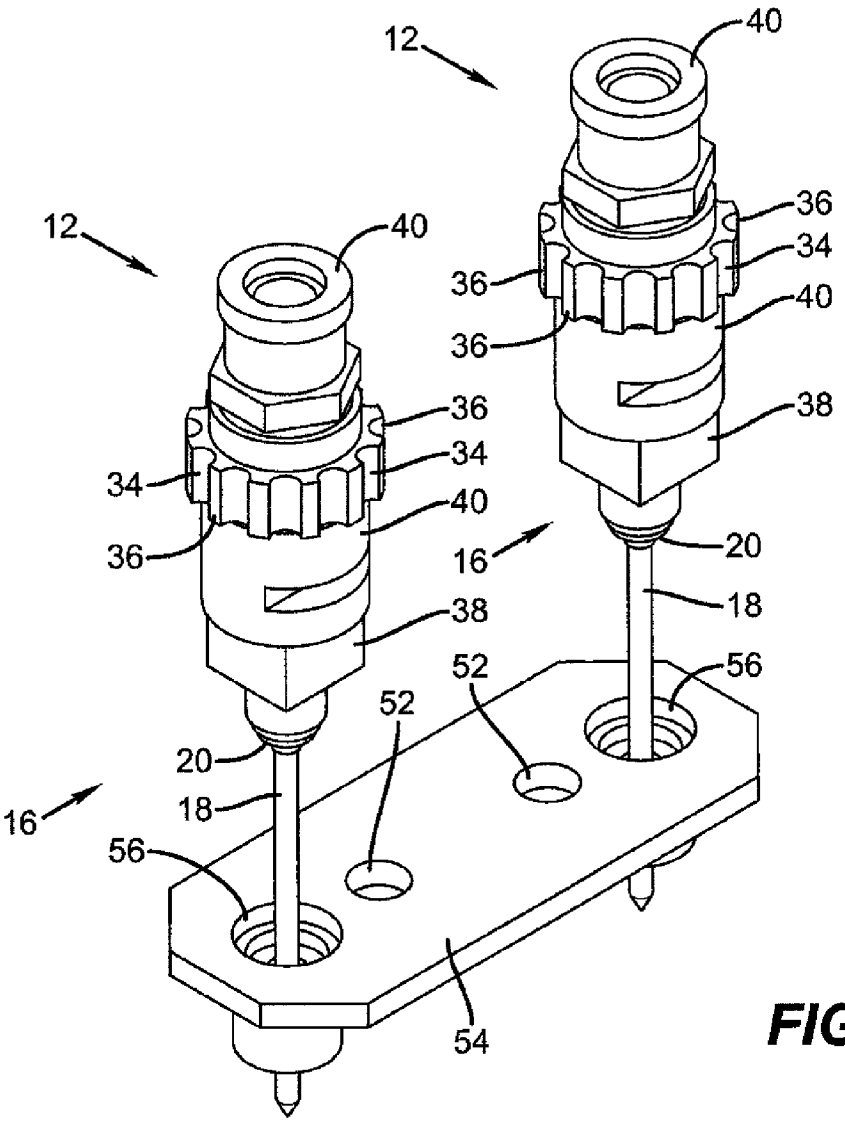
FIG. 2 is a schematic perspective view of a portion of the example embodiment shown in FIG. 1.

Referring to FIGS. 1 and 2, an example embodiment of a tank filling apparatus 10 is shown. Apparatus 10 includes a plurality of alignment mechanisms 12 movably positionable in or on a needle holding structure 14. A bracket 15 removably affixed to needle holding structure 14 can be used to retain alignment mechanisms 12 in position in or on needle holding structure 14. Each alignment mechanism 12 includes a filling device 16, for example, a "pencil tip" style needle 18.

A "pencil tip" style needle 18 includes a sharp point on center and at least one cross drilled hole to allow fluid to exit needle 18. Typically, fluid does not exit from the end of needle 18. Instead, fluid is pushed out of the sides of needle 18 through the cross drilled hole(s). However, other types of needles, such as a hypodermic needle, can be used.

Needle 18 has a first end 20 connectably in fluid communication with a fluid source 22 and a second end 24 including at least one fluid outlet port 26. In the embodiment shown in FIGS. 1 and 2, needle 18 includes two fluid outlet ports 26. However, other configurations can include more than or less than two fluid outlet ports 26. Needles 18 are inserted through openings 56 located in a top cover 54 of a tank 30 to be filled (described in more detail with reference to FIGS. 5 and 6).

Figure 7B:
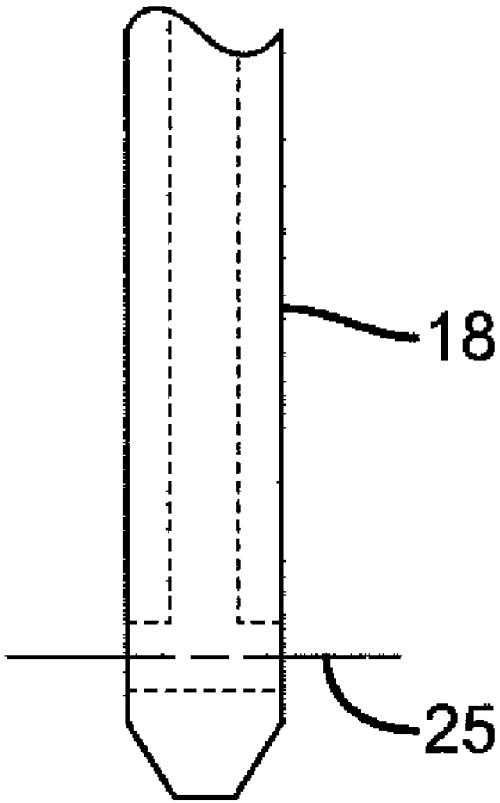
FIG. 7B is a schematic side view of a needle, as viewed perpendicular to the axis of a fluid port of the needle.
Figure 7A:
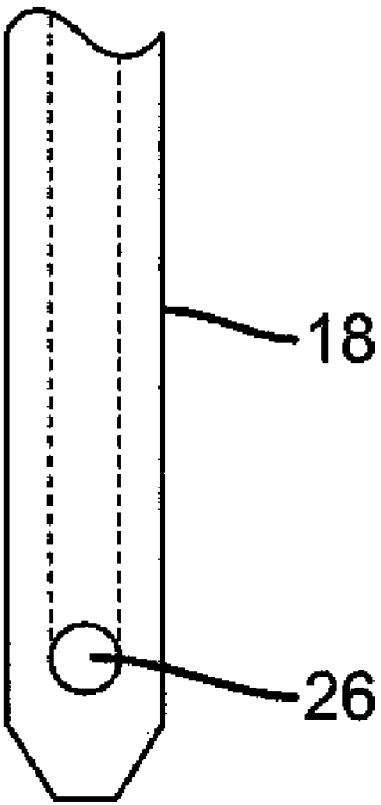
FIG. 7A is a schematic side view of a needle, as viewed facing a fluid port of the needle.

Referring to FIGS. 7A and 7B, needle 18 is shown in more detail. FIG. 7A shows an enlarged side view of needle 18 looking directly into a fluid outlet port 26. FIG. 7B is a side view of needle 18 rotated 90 degrees from FIG. 7A, so that the axis 25 of the fluid outlet ports 26 (i.e. the axis 25 of the cross-drilled hole forming fluid outlet ports 26) is shown. In this example, the axis 25 is perpendicular to the length of needle 18, but in other examples it may be advantageous for the axis of the fluid outlet port(s) 26 to be nonperpendicular to needle 18.

Figure 3:
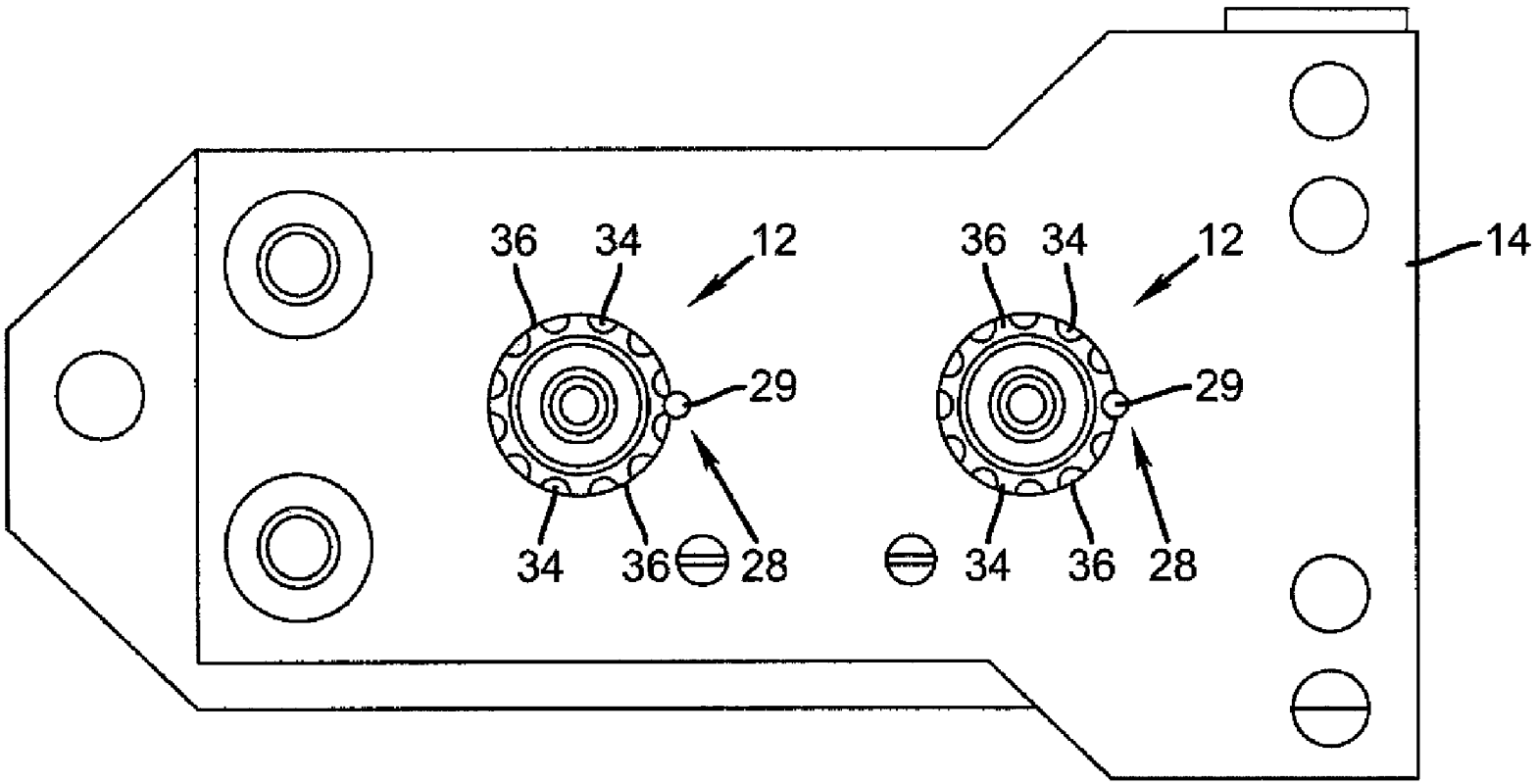
FIG. 3 is a schematic perspective view of a portion of the example embodiment shown in FIG. 1.
Figure 4:
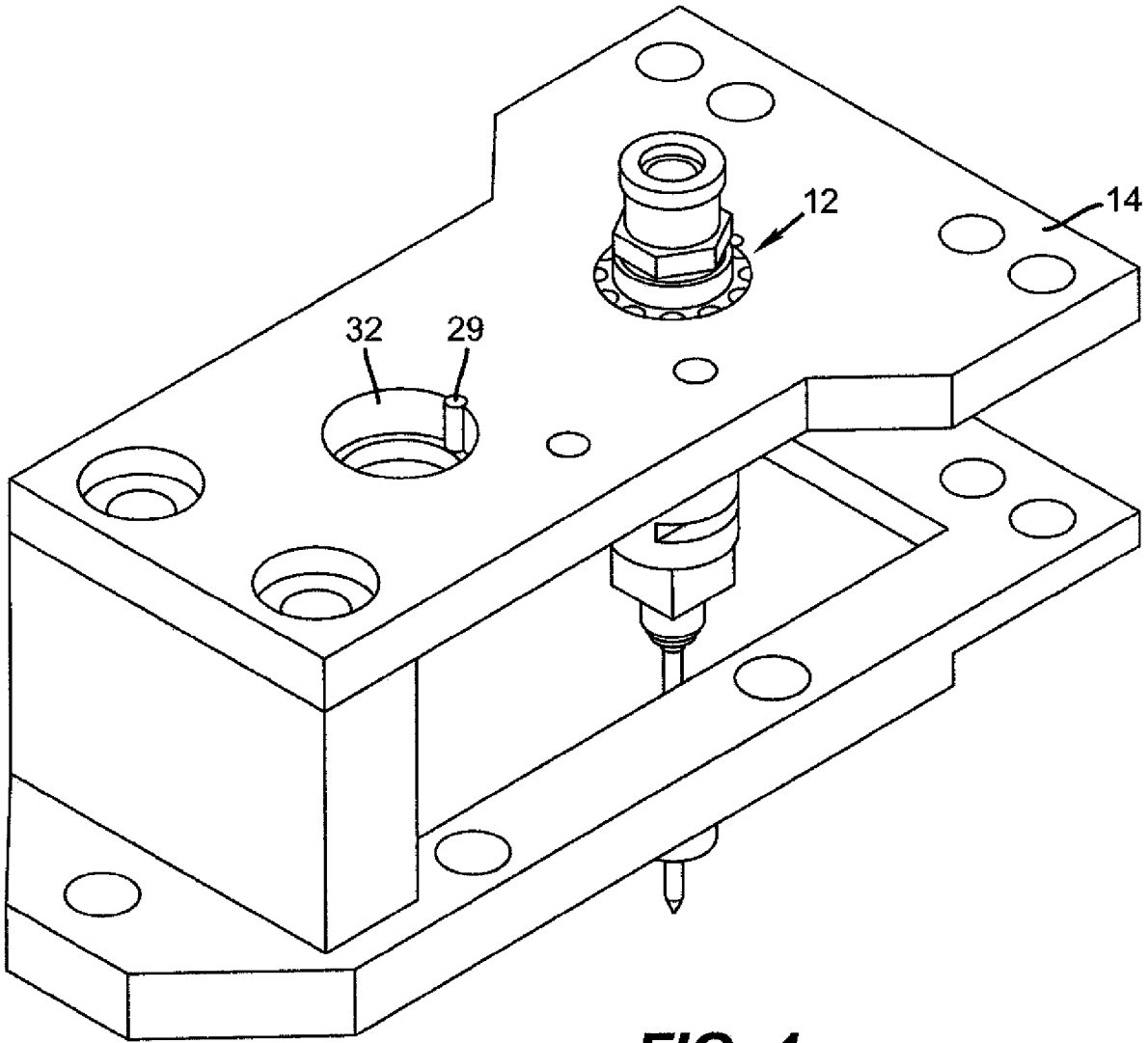
FIG. 4 is a schematic perspective view of a portion of the example embodiment shown in FIG. 1.

Referring to FIGS. 3 and 4, needle holding structure 14 includes a locking mechanism 28 associated with each alignment mechanism 12 that is operable to retain each alignment mechanism 12 in position in or on needle holding structure 14. Needle holding structure 14, for example, a plastic or metal plate, is shaped or configured to allow each alignment mechanism 12 to be moved so as to orient the axis 25 of at least one fluid outlet port 26 of each needle 18 substantially parallel with a length dimension of tank 30. In the example shown in FIG. 5, the axis 25 of fluid ports 26 and also the length dimension 44 of tank 30 are parallel to arrows 27.

Each alignment mechanism 12 is removably positionable, for example, in a recess 32 of needle holding structure 14. Each alignment mechanism 12 is rotatable, when removed from needle holding structure 14, so that the axis 25 of at least one fluid outlet port 26 of each needle 18 can be oriented substantially parallel with the length dimension of tank 30. Each alignment mechanism 12 is retained in position by locking mechanism 28, for example, a pin 29 affixed to a side of recess 32, when each alignment mechanism 12 is located in needle holding structure 14.

Referring back to the example of FIGS. 2 and 3, each alignment mechanism 12 is a sprocket style mechanism 34 including a plurality of teeth 36 (twelve teeth 36, as shown more clearly of FIG. 3). The plurality of teeth 36 are positioned relative to each other on sprocket style mechanism 34 to provide 30 degrees of angular rotation between adjacent teeth 36 in this example. However, other configurations can provide more or less degrees of angular rotation.

Alternatively stated, sprocket style mechanism 34, as shown in FIGS. 2 and 3, provides twelve incremental steps for needle alignment around the circumference of the needle. However, other configurations can provide more or less incremental steps for needle alignment.

When sprocket style mechanism 34 is provided with a greater number of incremental steps, for example, more than 12, (or smaller number of degrees of angular rotation between adjacent teeth 36), less care can be taken when inserting needle 18 into alignment mechanism 12 as compared to a filling process that does not use alignment mechanism 12. This is because alignment mechanism 12 with teeth 36 is capable of sufficiently aligning the at least one fluid outlet port 26 of needle 18 substantially parallel with the length dimension of tank 30 such that tank 30 can be filled with fluid.

Needle 18 can be inserted into alignment mechanism 12 using conventional techniques. For example, needle 18 can be inserted into a gasket 38 that is inserted into a threaded pipe(s) 40 that is connected to alignment mechanism 12.

Figure 5:
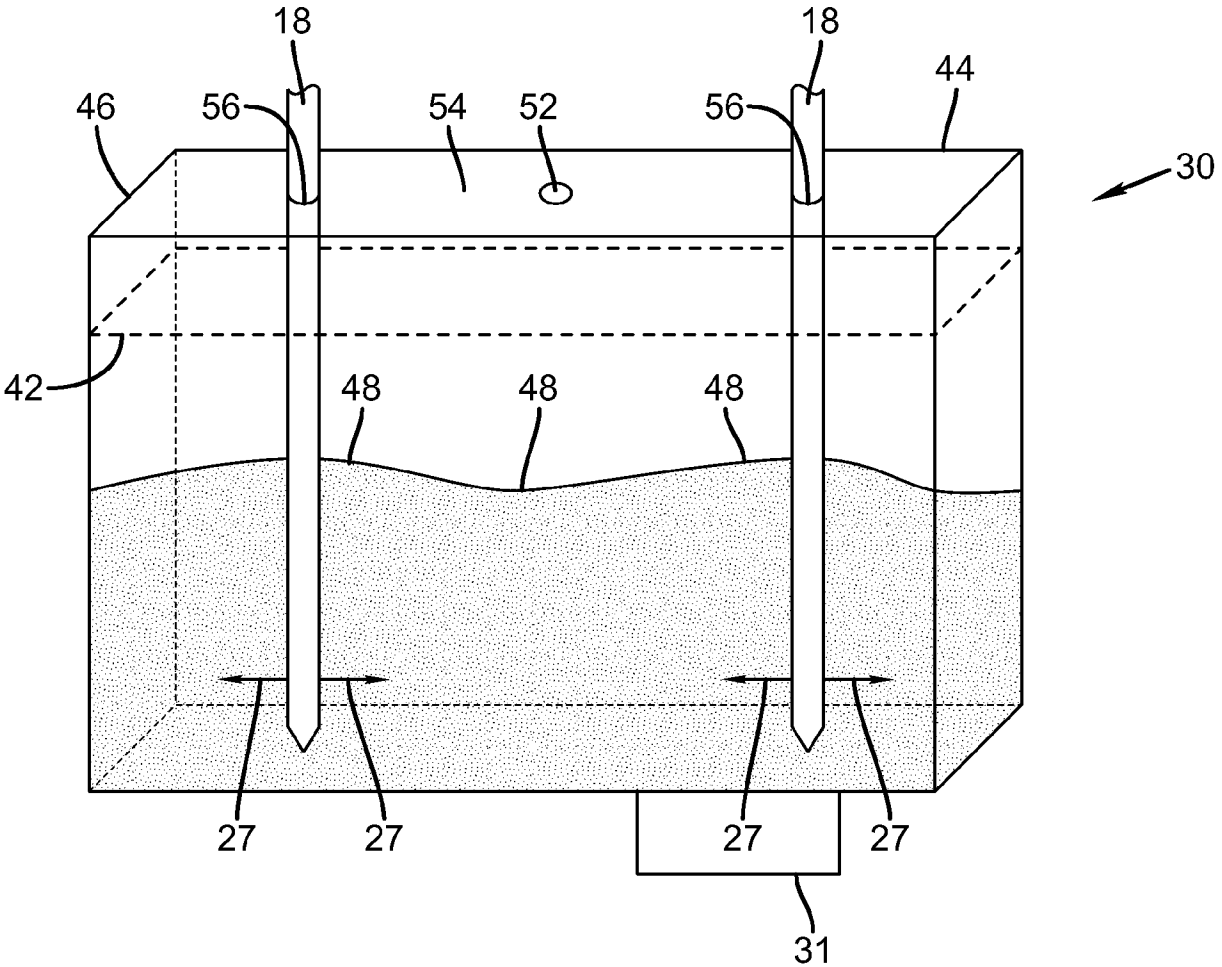
FIG. 5 is a schematic side view of a tank being filled using needles oriented with fluid port axes along the length dimension of the tank.
Figure 6:
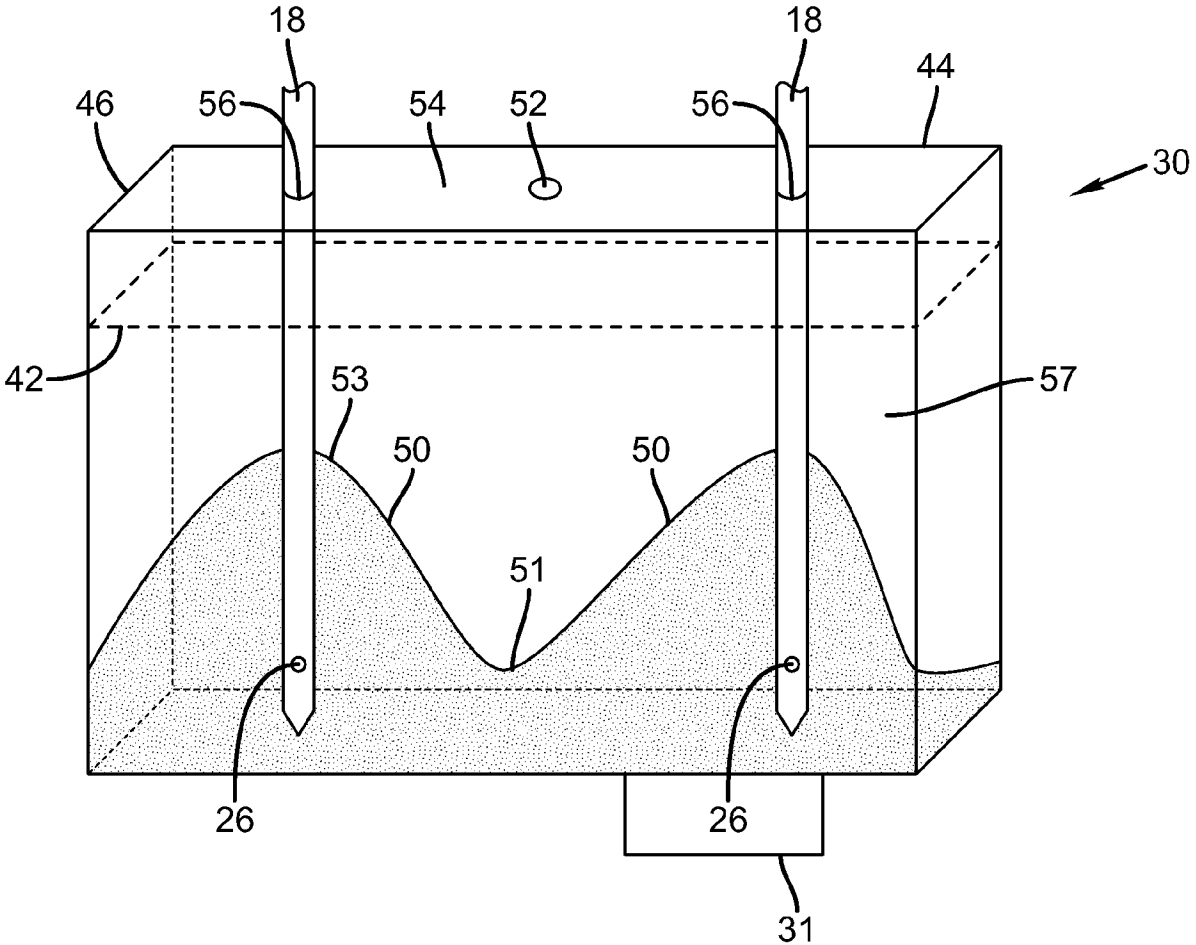
FIG. 6 is a schematic side view of a tank being filled using needles oriented with fluid port axes not along the length dimension of the tank.

Referring to FIGS. 5 and 6, needles 18 are shown inserted in a porous media 42 positioned or included in tank 30. Typically, needles 18 are inserted through openings 56 located in a top cover 54 of tank 30. Tank 30 has a length dimension 44 and a width dimension 46. Length dimension 44 exceeds width dimension 46.

As shown in the example of FIG. 5, the axes 25 of at least one fluid outlet port 26 of both needles 18 are substantially parallel with length dimension 44 of tank 30. Arrows 27 represent the direction of fluid travel from port(s) 26. This results in proper filling of tank 30 as can be determined by the substantially even fill line 48 found on porous media 42 as viewed in cross section from a plane perpendicular to length dimension 44. This can be contrasted with fill line 50 found on porous media 42 of tank 30 shown in FIG. 6.

As shown in the comparative example of FIG. 6, the axes 25 of at least one fluid outlet port 26 of both needles 18 are not substantially parallel with length dimension 44 of tank 30. This results in improper filling of tank 30 as can be determined by the uneven fill line 50 found on porous media 42 as viewed in cross section from a plane perpendicular to length dimension 44. The likelihood of ink becoming trapped and unavailable for printing in tank 30 is significantly higher in the tank 30 shown in FIG. 6 as compared to the one shown in FIG. 5.

During printing, ink is delivered to the printhead (not shown) via tank port 31. If ink becomes depleted in the region of the minimum fill level 51 in FIG. 6, for example, and if ink is remaining at a position of fill level 53 that is remote from tank port 31, then that remaining ink may become trapped. This is because capillary forces on the ink drop off in the region where the ink has been depleted. In other words, it is advantageous when filling an ink tank not to have a fill line such that a minimum fill level 51 is positioned between tank port 51 and fill level 53 that is higher than fill level 51 but more remote from tank port 31. Filling a long, narrow tank 30 using two needles 18 that are displaced from one another along the length dimension 46 of tank 30 is particularly susceptible to this problem, unless care is taken to properly orient the axes 25 of the fluid outlet ports 26 of the needles 18. Accordingly, one aspect of this invention is the deliberate adjustment of the orientation of the axis 25 of the fluid port 26 of needle 18 to provide a desirable ink fill profile within the porous media 42 in tank 30.

During the filling process, after tank 30 has been provided at a filling station, needles 18 are oriented such that the at least one fluid outlet port 26 is substantially parallel with length dimension 44 of tank 30. Each needle 18 is then inserted into porous media 42 located in tank 30. This can be accomplished either manually or by using an automated system. Tank 30 is then filled with fluid from fluid source 22. While tank 30 is being filled, needles 18 can optionally be moved in a direction opposite to the direction of needle 18 insertion in order to maintain filling times and provide more consistent fluid distribution in porous media 42.

Typically, each needle 18 is oriented by providing each needle 18 in an alignment mechanism 12. The position of each alignment mechanism 12 is adjusted such that the axis 25 of at least one fluid outlet port 26 of each needle 18 is substantially parallel with length dimension 44 of tank 30. Each alignment mechanism 12 is retained in the position after being adjusted.

When each alignment mechanism 12 is a sprocket style mechanism 34 that is removably positionable in recess 32 of needle holding structure 14, adjusting the position of each alignment mechanism 12 can be accomplished by removing each sprocket style mechanism 34 from recesses 32 and rotating each sprocket style mechanism 34 such that the axis 25 of at least one fluid outlet port 26 of needle 18 is substantially parallel with length dimension 44 of tank 30. In this situation, each alignment mechanism 12 is retained in the position by positioning each sprocket style mechanism 34 back in recess 32 of needle holding structure 14 such that an associated locking mechanism 28 of needle holding structure 14 engages each sprocket style mechanism 34. Each needle can be oriented such that the axis 25 of at least one fluid outlet port 26 of each needle 18 is at an angle of less than or equal to 30 degrees relative to length dimension 44 of tank 30.

During the filling process, no vacuum is applied to tank 30 either prior to or during filling the filling process. This helps to reduce cost associated with the filling process. Air trapped inside of tank 30 is vented through a vent 52 typically located in top cover 54 during the filling process. Filling speeds are maintained by using a plurality of needles 18 to fill tank 30 although a single needle 18 can be used depending on the specific application contemplated.

In the embodiment described above, the axis 25 of fluid port 26 is preferably aligned to be substantially parallel to the length dimension 44 of tank 30. In a more general embodiment, it may be advantageous to align the axis 25 of fluid port 26 to be along a preferred direction which may be the length dimension 44 of the tank, along the width dimension 46 of the tank 30, or along some other direction. The preferred direction may be empirically chosen for the particular tank geometry (including the location of tank port 31), for example, in order to provide an ink distribution after filling which enables a preferred amount of ink availability for printing during the life of the ink tank 30.

Figure 8:
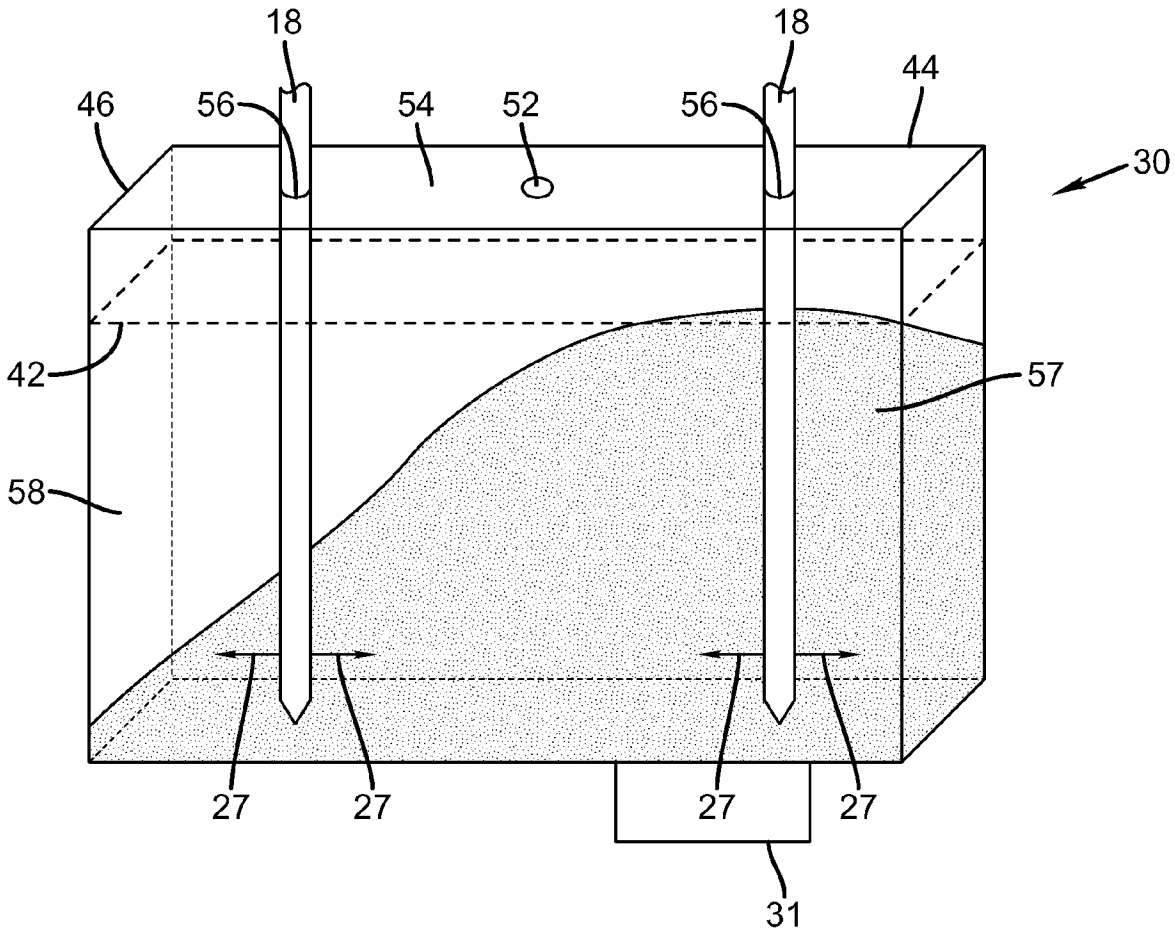
FIG. 8 is a schematic side view of a tank being filled using a single port needle and a double port needle, with all fluid port axes oriented along the length dimension of the tank.
Figure 9:
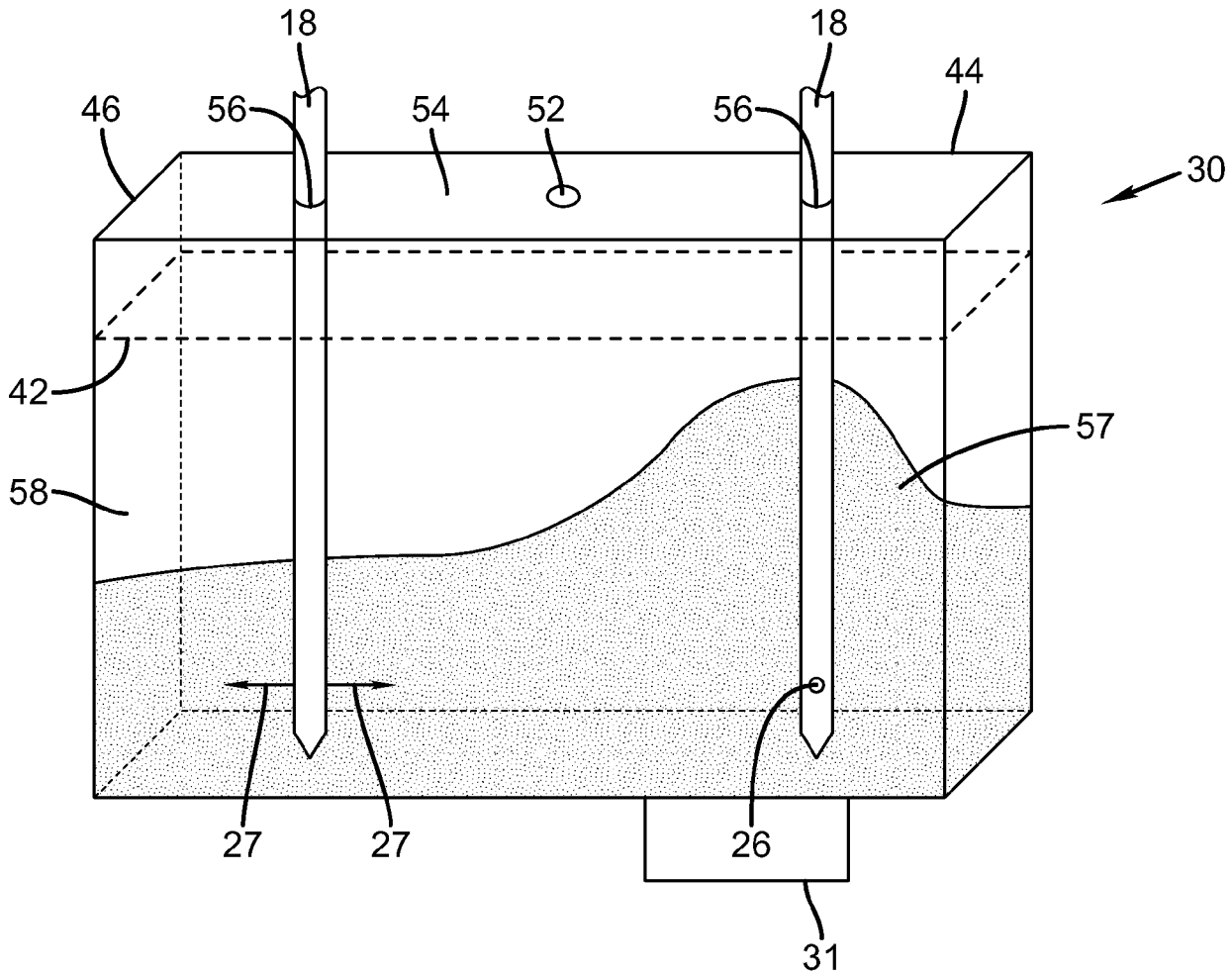
FIG. 9 is a schematic side view of a tank being filled using one needle with its axes oriented along the length dimension and the other needle with its axes oriented along the width dimension of the tank.

For example, FIGS. 8 and 9 show ink fill distributions which are generally at a higher level in a region 57 of the tank 30 which is near to the tank port 31 and at a lower level in a region 58 of tank 30 which is remote from the tank port. The ink fill distribution of FIG. 8 can be accomplished, for example, by providing a needle 18 in region 58 with a single fluid port 26 that is oriented along the length dimension 44 and facing the needle in region 57, and providing a needle 18 in region 57 with two fluid ports 26 both having axes oriented along length dimension 44 and facing in opposite directions. The ink fill distribution of FIG. 9 can be accomplished, for example, by providing a needle 18 in region 58 with two fluid ports 26 both having axes oriented along length dimension 44 and facing in opposite directions, and providing a needle 18 in region 57 with two fluid ports 26 both having axes oriented along the width dimension 46.

Accordingly, within the context of this invention, when axis 25 of fluid port 26 has a component that is in the plane defined by the length dimension 44 and the width dimension 46 of the tank 30, and when axis 25 of fluid port 26 also has a component that is out of that plane, then what is meant by the axis 25 of the fluid port 26 being oriented substantially parallel to the length dimension 44 or to the width dimension 46 is that the component of the axis 25 that is in said plane is substantially parallel to the length dimension 44 or the width dimension 46 respectively.

The invention has been described in detail with particular reference to certain preferred embodiments thereof, but it will be understood that variations and modifications can be effected within the scope of the invention. For example, ink distributions may also be tailored by using needles 18 including fluid ports 26 having different cross-sectional areas.

PARTS LIST

10 tank filling apparatus
12 alignment mechanisms
14 needle holding structure
15 bracket
16 filling device
18 needle
20 first end
22 fluid source
24 second end
25 axis of fluid outlet port
26 fluid outlet port
27 arrows
28 locking mechanism
29 pin
30 tank
31 tank port
32 recess
34 sprocket style mechanism
36 teeth
38 gasket
40 threaded pipe(s)
42 porous media
44 length dimension
46 width dimension
48 even fill line
50 fill line
51 minimum fill level
52 vent
53 fill level remote from tank port
54 top cover
56 openings
57 region of tank near tank port
58 region of tank remote from tank port

The invention claimed is:

1. A method of filling a tank with a fluid comprising:

providing the tank including a porous media positioned therein, the tank having a length dimension and a width dimension, the tank including a cover, the cover including a plurality of openings;

providing a plurality of needles, each needle having a first end connectable in fluid communication with a fluid source and a second end including a fluid outlet port, the fluid outlet port having an axis;

orienting each needle such that the axis of the fluid outlet port is substantially parallel with a preferred direction, the preferred direction being along one of the length dimension and the width dimension of the tank;

inserting each needle into the porous media positioned within the tank through a corresponding opening located in the cover of the tank; and filling the tank with fluid from the fluid source.

2. The method of claim 1, wherein orienting each needle such that the axis of the fluid outlet is substantially parallel with the preferred direction comprises:

providing each needle in an alignment mechanism;

adjusting a position of each alignment mechanism such that the axis of the fluid outlet port of each needle is substantially parallel with the preferred direction; and retaining each alignment mechanism in the position.

3. The method of claim 2, each alignment mechanism being a sprocket style mechanism removably positionable in a needle holding structure including a locking mechanism associated with each alignment mechanism, wherein adjusting the position of each alignment mechanism such that the axis of the fluid outlet port of each needle is substantially parallel with the preferred direction comprises:

rotating each sprocket style mechanism such that the axis of the fluid outlet port of the each needle is substantially parallel with the preferred direction, and wherein retaining each alignment mechanism in the position comprises:

positioning each sprocket style mechanism in each needle holding structure such that the associated locking mechanism of each needle holding structure engages each sprocket style mechanism.

4. The method of claim 1, wherein orienting each needle such that the axis of the fluid outlet port is substantially parallel with the preferred direction includes orienting the axis of the fluid outlet port of each needle such that the axis of the fluid outlet port of each needle is at an angle of less than or equal to 30 degrees relative to the preferred direction.

5. The method of claim 1, wherein filling the tank with fluid from the fluid source includes filling the tank with fluid from the fluid source without applying a vacuum to the tank.

6. The method of claim 1, the length dimension exceeding the width dimension of the tank, wherein orienting each needle such that the axis of the fluid outlet port is substantially parallel with the preferred direction includes orienting each needle such that the axis of the fluid outlet port is substantially parallel with the length dimension of the tank.

7. The method of claim 1, wherein orienting each needle such that the axis of the fluid outlet port is substantially parallel with the preferred direction includes orienting one needle such that the axis of the fluid outlet port is substantially parallel with the length dimension of the tank and orienting another needle such that the axis of the fluid outlet port is substantially parallel with the width dimension of the tank.

8. The method of claim 1, the fluid outlet port being a first fluid outlet port, wherein one of the plurality of needles includes a second fluid outlet port.

9. The method of claim 8, the second fluid outlet port having an axis, wherein the axis of the second fluid outlet port is substantially parallel to the axis of the first fluid outlet port.

10. The method of claim 1, each fluid outlet port having a cross sectional area, wherein the cross sectional area of one of the fluid outlet ports is greater than the cross sectional area of another of the fluid outlet ports.

11. The method of claim 1, wherein orienting each needle such that the axis of the fluid outlet port is substantially parallel with a preferred direction includes rotating each needle.

12. A method of filling a tank with a fluid comprising:

providing the tank including a porous media positioned therein, the tank having a length dimension and a width dimension;

providing a plurality of needles, each needle having a first end connectable in fluid communication with a fluid source and a second end including a fluid outlet port, the fluid outlet port having an axis;

orienting each needle such that the axis of the fluid outlet port is substantially parallel with a preferred direction, the preferred direction being along one of the length dimension and the width dimension of the tank;

inserting each needle into the porous media positioned within the tank; and filling the tank with fluid from the fluid source, wherein orienting each needle such that the axis of the fluid outlet is substantially parallel with the preferred direction comprises:

providing each needle in an alignment mechanism, each alignment mechanism being a sprocket style mechanism removably positionable in a needle holding structure including a locking mechanism associated with each alignment mechanism;

adjusting a position of each alignment mechanism such that the axis of the fluid outlet port of each needle is substantially parallel with the preferred direction; and retaining each alignment mechanism in the position, wherein adjusting the position of each alignment mechanism such that the axis of the fluid outlet port of each needle is substantially parallel with the preferred direction comprises:

rotating each sprocket style mechanism such that the axis of the fluid outlet port of the each needle is substantially parallel with the preferred direction, and wherein retaining each alignment mechanism in the position comprises:

positioning each sprocket style mechanism in each needle holding structure such that the associated locking mechanism of each needle holding structure engages each sprocket style mechanism.

* * * * *